US008292379B2

(12) United States Patent
Hernandez

(10) Patent No.: US 8,292,379 B2
(45) Date of Patent: Oct. 23, 2012

(54) MOBILE CABINET AND SUPPORT

(76) Inventor: Luis E. Hernandez, North Bergen, NJ (US)

( * ) Notice: Subject to any disclaimer, the term of this patent is extended or adjusted under 35 U.S.C. 154(b) by 330 days.

(21) Appl. No.: 12/659,298

(22) Filed: Mar. 3, 2010

(65) Prior Publication Data

US 2010/0231104 A1 Sep. 16, 2010

Related U.S. Application Data

(60) Provisional application No. 61/202,561, filed on Mar. 12, 2009.

(51) Int. Cl.
*A47B 46/00* (2006.01)

(52) U.S. Cl. ..... 312/249.12; 312/313; 312/283

(58) Field of Classification Search ..... 312/249.11–249.12, 283, 285, 287, 313
See application file for complete search history.

(56) References Cited

U.S. PATENT DOCUMENTS

| | | | | |
|---|---|---|---|---|
| 1,092,564 | A * | 4/1914 | Deming | 312/218 |
| 1,492,428 | A * | 4/1924 | Cook | 62/261 |
| 2,182,327 | A * | 12/1939 | Wanz | 312/285 |
| 2,703,267 | A * | 3/1955 | Purdy | 312/225 |
| 3,285,685 | A * | 11/1966 | Hewett | 312/287 |
| 4,123,130 | A * | 10/1978 | Locke | 312/285 |
| 4,491,375 | A * | 1/1985 | Ugalde | 312/249.9 |
| 5,016,948 | A * | 5/1991 | Welch et al. | 312/249.12 |
| D352,106 | S | 11/1994 | Fanney et al. | |
| 5,518,310 | A | 5/1996 | Ellman et al. | |
| 5,611,553 | A | 3/1997 | Schoeman et al. | |
| 5,713,584 | A * | 2/1998 | Crane | 280/47.35 |
| 6,113,129 | A | 9/2000 | Marques et al. | |
| 6,663,202 | B2 * | 12/2003 | Spann | 312/249.12 |
| 7,044,569 | B1 * | 5/2006 | Relyea et al. | 312/249.11 |
| D523,607 | S | 6/2006 | Huguet | |
| 7,284,393 | B1 | 10/2007 | Macmillan | |
| 2003/0201699 | A1 * | 10/2003 | Hong et al. | 312/290 |
| 2005/0099102 | A1 * | 5/2005 | Villarreal | 312/237 |
| 2005/0178298 | A1 | 8/2005 | Rossini | |
| 2005/0236947 | A1 | 10/2005 | LeClear et al. | |
| 2007/0088460 | A1 | 4/2007 | Holmes et al. | |
| 2008/0000171 | A1 | 1/2008 | McKay et al. | |
| 2008/0036343 | A1 | 2/2008 | Wang | |
| 2008/0164792 | A1 | 7/2008 | Goldberg | |

FOREIGN PATENT DOCUMENTS

| | | | |
|---|---|---|---|
| JP | 10-295469 | A | 11/1998 |
| WO | WO 94/15824 | A1 | 7/1994 |

* cited by examiner

*Primary Examiner* — Hanh V Tran
(74) *Attorney, Agent, or Firm* — Richard C. Litman

(57) ABSTRACT

The mobile cabinet and support is a portable storage cabinet and work surface for use in an office-type environment. The mobile cabinet and support includes a base with a plurality of wheels rotatably secured thereto. A plurality of vertical support members are secured between the base and an upper panel to define an open interior region. At least one front sliding drawer is slidably disposed within an upper portion of the open interior region and at least one side sliding drawer is slidably disposed within a lower portion of the open interior region. Additionally, at least one drop leaf panel is pivotally attached to an adjacent pair of the plurality of vertical support members by hinges or the like.

9 Claims, 2 Drawing Sheets

MOBILE CABINET AND SUPPORT

CROSS-REFERENCE TO RELATED APPLICATION

This application claims the benefit of U.S. Provisional Patent Application Ser. No. 61/202,561, filed Mar. 12, 2009.

BACKGROUND OF THE INVENTION

1. Field of the Invention

The present invention relates to cabinets, and more particularly to a mobile cabinet and support that provides a multi-function cabinet that includes at least one extendable panel and at least one sliding drawer integrated therein.

2. Description of the Related Art

In recent years, the computer has become an important and generally necessary tool that is commonly utilized for business, home, educational and recreational purposes. It is desirable to be able to transport the computer and its capabilities to various locations within an office setting or the like. Due to this importance, portable or laptop computers were developed relatively early in the history of computers. Today, laptop computers are used by many people at many different locations, including the office, home and school. The portability of a laptop computer allows the user to work on the computer in a wide variety of settings.

While laptop computers greatly improve the ability to do work away from the typical office or home setting, there are many issues with regard to transporting the computer and having space to work on the computer at the remote location or site. To complicate this matter, utilization of the laptop computer is made more beneficial by being able to utilize various peripheral equipment and work materials with the computer. For example, many people find it useful to connect the computer to a portable printer, utilize a mouse with the computer and have access to various books or other materials when working on the laptop computer. Transporting all this equipment and material with the computer can be quite difficult. In addition, once at the remote location, the user typically finds himself or herself significantly limited with regard to free workspace.

Most currently available laptop carrying devices are no more than large briefcases or small luggage devices that are specially padded to protect the computer from contact damage. The user must still try to work with the laptop computer on his or her lap or to seek out a relatively flat spot on which to place the laptop. Unfortunately, this can be quite uncomfortable for typing on the computer's keyboard, which can significantly reduce the person's work efficiency. The lack of space and organizational placement of the computer, computer peripherals and other materials compounds this problem. In addition, the presently available laptop carrying devices do not solve the problem of having to carry the computer, its peripheral equipment and any other work materials to the remote location. The user wanting to work on a laptop computer at a remote location is typically stuck having to haul or carry all of the necessary equipment to the remote location, often resulting in multiple trips or a precarious balancing of all the equipment. Because the computer and some of the other equipment are electronic in nature, dropping it can damage or destroy the equipment.

Although pushcarts are well known, such carts are not sized or contoured for specific usage with laptop computers or for other office-related activities. A typical cart does not, for example, provide the user with organizational capabilities, allowing the user to use the computer on one surface, and also providing separate storage for books or pens, for example.

It would be desirable to provide a portable workspace for laptop computers or other office, school or work-related equipment or activities that can efficiently and effectively store and transport a laptop computer, its peripheral equipment, or the like, and which provides a suitable amount of workspace and organized storage that allows the user to accomplish the desired tasks. Thus, a mobile cabinet and support solving the aforementioned problems is desired.

SUMMARY OF THE INVENTION

The mobile cabinet and support provides a portable storage cabinet and work surface. The mobile cabinet and support includes a base having opposed upper and lower surfaces, with a plurality of wheels attached to the lower surface of the base. The wheels may be castors or the like. Preferably, the base is substantially rectangular, with four such castors being positioned at the respective corners thereof.

A plurality of vertical support members having opposed upper and lower ends are further provided, with the lower ends thereof each being secured to the upper surface of the base. Preferably, four such vertical support members are provided, and are secured to the upper surface of the base at the respective corners thereof. An upper panel is secured to the upper ends of the plurality of vertical support members, with the base, the upper panel and the plurality of vertical supports defining an open interior region.

At least one front sliding drawer is slidably received within an upper portion of the open interior region and at least one side sliding drawer is slidably received within a lower portion of the open interior region. Additionally, at least one drop leaf panel is pivotally secured to an adjacent pair of the plurality of vertical support members by hinges or the like.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
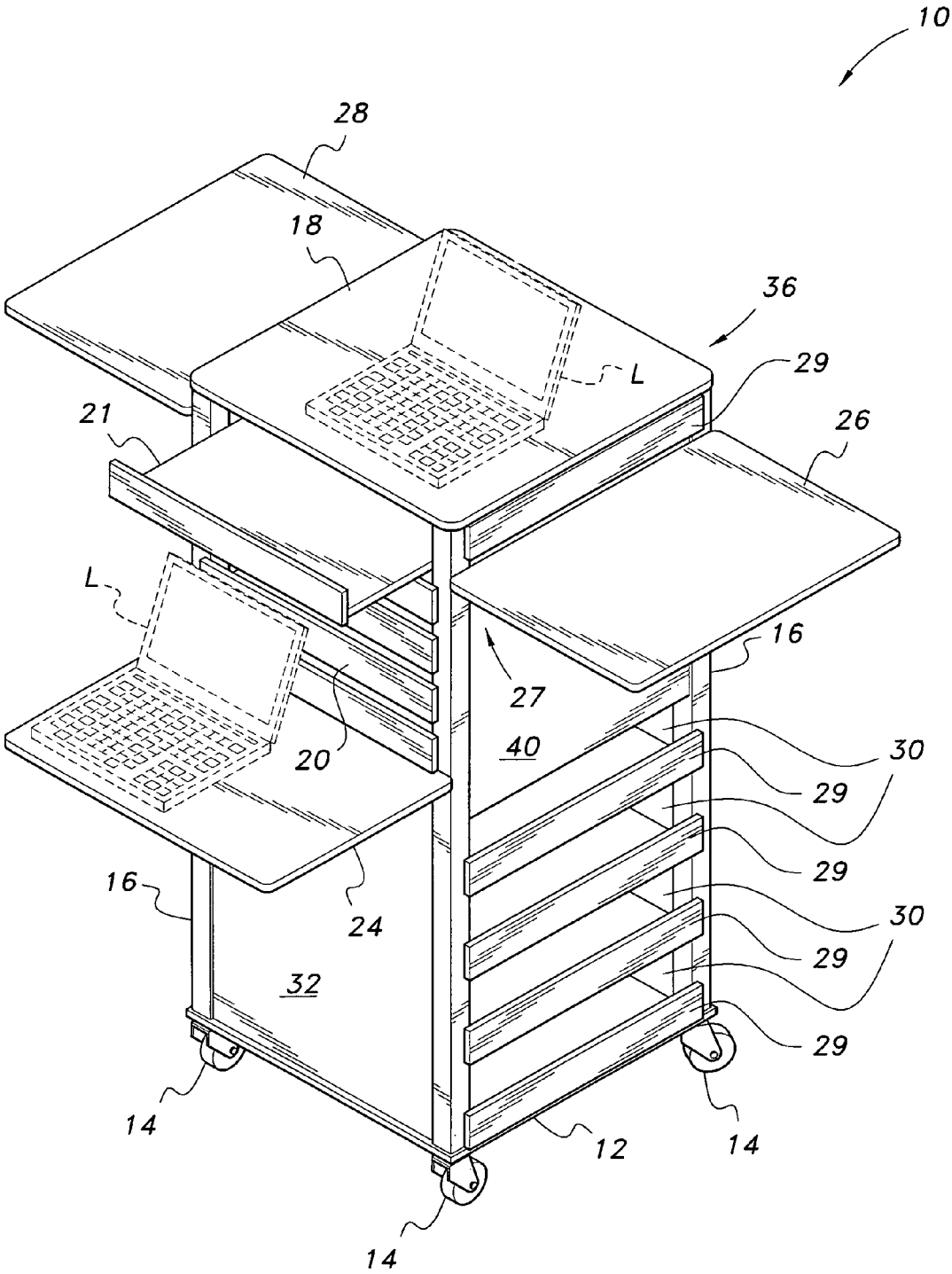
FIG. 1 is a perspective view of a mobile cabinet and support according to the present invention as seen from the right front with both side drop leaf panels and the front drop leaf panel extended.
Figure 2:
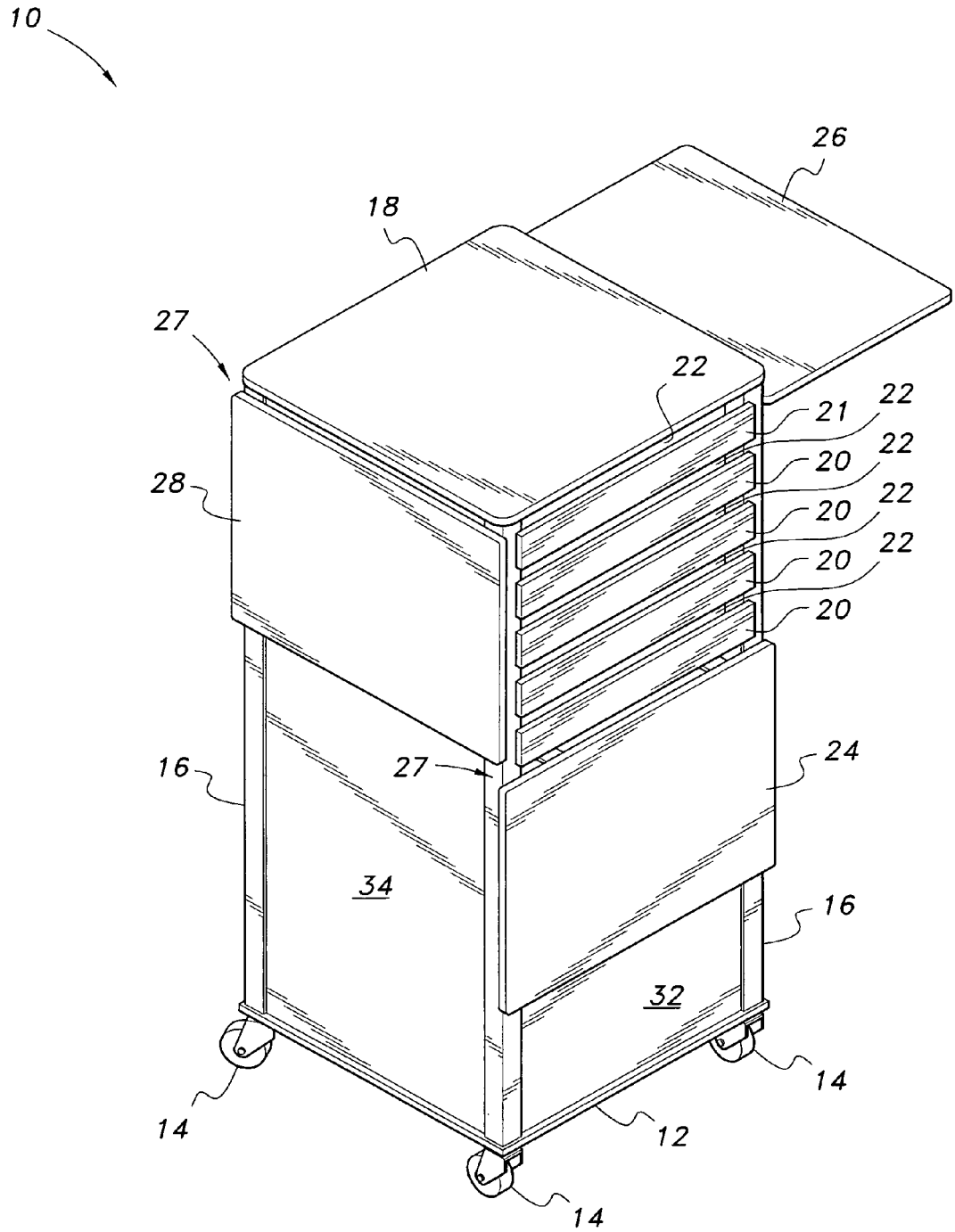
FIG. 2 is a perspective view of the mobile cabinet and support according to the present invention as seen from the left front with only one of the drop leaf panels extended.

Referring to FIGS. 1 and 2, the mobile cabinet and support 10 provides a portable storage cabinet and work surface. The mobile cabinet and support 10 includes a base 12 having opposed upper and lower surfaces, with a plurality of wheels 14 being rotatably secured to the lower surface of the base 12. The wheels 14 may be castors or the like. Preferably, the base 12 is substantially rectangular in contour, with four such castor wheels 14 being positioned at the respective corners thereof. Wheels 14 allow the cabinet 10 to be easily transported around an office-type setting or the like.

A plurality of vertical support members 16 having opposed upper and lower ends are further provided, with the lower ends thereof each being secured to the upper surface of the base 12. Preferably, four such vertical support members 16 are provided, and are secured to the upper surface of the base 12 at the respective corners thereof. An upper panel 18 is secured to the upper ends of the plurality of vertical support members 16, with the base 12, the upper panel 18 and the plurality of vertical supports 16 defining an open interior region 30. As shown, the upper panel 18 provides a workspace or work surface for supporting a laptop computer L, for example.

It should be understood that the relative dimensions and contouring of base 12 and upper panel 18 are dependent upon the particular needs and desires of the user. Exemplary dimensions include a width of approximately 15½ inches, a length of approximately 18 inches and a thickness of approximately ½ an inch for upper panel 18, and a width of approximately 15¾ inches, a length of approximately 15¾ inches and a thickness of approximately ¾ of an inch for base 12. Each vertical support member 16 may have a vertical height of approximately 41 inches, and a cross-sectional width of approximately two inches and a cross-sectional length of approximately 1½ inches. The vertical support members, base and upper panel may be formed from any desired material, such as wood or metal, for example.

At least one front sliding drawer 20 is slidably received within an upper portion of the open interior region 30, and at least one side sliding drawer 29 is slidably received within a lower portion of the open interior region 30. As shown in FIGS. 1 and 2, four such front drawers 20 may be slidably received within the upper portion of the interior 30, although the cabinet 10 may have a greater or lesser number of front drawers 20, as desired. As shown in FIG. 1, a sliding panel 21, adapted for writing or the like, is also preferably slidably received within open interior region 30, and is positioned above the four drawers 20. It should also be understood that the cabinet 10 may have a greater or lesser number of side sliding drawers 29, as desired, and that the number, relative dimensions, and configuration of drawers 20, 29 is shown in FIGS. 1 and 2 for exemplary purposes only. Preferably, at least two sliding side drawers 29 are provided. As noted above, any desired number of drawers may be utilized. For example, four front drawers 20 and five side drawers 29 may alternatively be provided. Further, the spacing between adjacent respective sets of drawers 20 and 29 may be varied, as desired. For example, a relatively large space may be provided between a pair of lower, adjacent side drawers 29, allowing, for storage of larger articles.

Drawers 20, 29 may be formed from wood, metal or any other desired material. It should be understood that the outward appearance of drawers 20, 29 is shown for exemplary purposes, and may include any desired configuration or ornamentation. It should be further understood that drawers 20, 29 are slidably mounted within cabinet 10 by any suitable type of brackets, sliding attachments, or mechanisms disposed within the interior of cabinet 10.

As shown, front sliding drawers 20 and panel 21 are preferably spaced apart from one another, with gaps or spaces 22 being formed therebetween, allowing the user to view the contents of drawers 20 without having to open them. Similarly, the side sliding drawers 29 are preferably spaced apart. As shown, the side sliding drawers 29 may be spaced apart from one another by a greater distance than that of front sliding drawers 20, thus providing a larger storage space in the lower portion of mobile cabinet and support 10. The deeper drawers 29 may be used for storing books, office supplies and the like. The spacing, configuration, and depth of drawers 20, 29 may vary, as desired.

Additionally, at least one drop leaf panel is pivotally secured to an adjacent pair of the plurality of vertical support members 16 by hinges 27 or the like. Hinges 27 are preferably mounted beneath the drop leaf panels, so as to be hidden from view in normal usage of the mobile cabinet 10. In FIGS. 1 and 2, three such drop leaf panels are shown. A front drop leaf panel 24 is pivotally secured to a pair of front vertical supports 16, and similar side drop leaf panels 26, 28 are secured to pairs of adjacent side vertical supports. As shown in FIG. 1, the front drop leaf panel 24 may be used to support a laptop computer L or the like, allowing the user to use the work surface of panel 24 from a seated position. Preferably, as shown, the front drop leaf panel 24 is pivotally secured below the front sliding drawers 20. A front panel 32 is preferably mounted to the adjacent front vertical supports 16. Based upon the exemplary dimensions given above, front panel 32 may have a height of approximately twenty-four inches, a width of approximately 12¾ inches, and a thickness of approximately ¾ of an inch. The drop leaf panels provide additional tabletop-type support or writing surfaces. Any suitable type of pivotal attachment may be utilized to allow the user to selectively rotate the drop leaf panels 24, 26, 28 between the extended, locked position shown in FIG. 1, and the folded position shown in FIG. 2.

FIG. 2 illustrates the drop leaf panels 24, 28 in the folded state. It should be understood that the relative dimensions and configuration of drop leaf panels 24, 26 and 28 may vary, as desired. Exemplary dimensions include a width of approximately twelve inches, a length of approximately sixteen inches and a thickness of approximately ½ an inch for front drop leaf panel 24, and a width of approximately 8¼ inches, a length of approximately fifteen inches and a thickness of approximately ½ of an inch for side drop leaf panels 26, 28. The drop leaf panels may be farmed from any desired material, such as wood, metal or the like.

As shown, the side sliding drawers 29 are preferably slidably mounted within a lower portion of the open interior region 30. Drawers 29 are mounted on only one side of the mobile cabinet and support 10. In the orientation of FIGS. 1 and 2, the drawers 29 are shown being exposed on the right side of cabinet 10, and the left side is covered with a sidewall 34. It should be understood that this orientation may be reversed. Similarly, the rear side, opposite the front sliding drawers 20, is covered by a rear wall 36.

As shown in FIG. 1, a side panel 40 is positioned above side sliding drawers 29, and side drop leaf panel 26 is pivotally secured adjacent an upper end of adjacent vertical support members 16. FIG. 2 shows drop leaf panel 28 in a folded configuration (at least partially covering side wall 34). Similarly, drop leaf panel 26 is pivotally secured to the upper portion of cabinet 10 opposite drop leaf panel 28, and may be folded over side panel 40.

The mobile cabinet and support 10 is well-adapted for use in an office-type environment, and may be used to support a laptop computer L, as shown, or to provide general workspace with writing and support surfaces for paper and the like. The cabinet 10 may be used for storing and supporting paper, pencils, pens, general office supplies, scissors, appointment books, a laptop charging station, food, beverages or the like. The mobile cabinet and support 10 is easily transportable and versatile in its uses.

It is to be understood that the present invention is not limited to the embodiments described above, but encompasses any and all embodiments within the scope of the following claims.

I claim:

1. A mobile cabinet and support, comprising:

a base having opposed upper and lower surfaces;

a plurality of wheels attached to the lower surface of the base;

a plurality of vertical support members having opposed upper and lower ends, the lower ends each being attached to the upper surface of the base;

an upper panel attached to the upper ends of the plurality of vertical support members, the base, the upper panel and the plurality of vertical supports defining an open interior region;

a plurality of front sliding drawers slidably disposed within an upper portion of the open interior region;

a plurality of side sliding drawers slidably disposed within a lower portion of the open interior region, wherein the uppermost side sliding drawer is lower than the lowermost front sliding drawer; and a plurality of drop leaf panels pivotally attached to the vertical support members, wherein at least one drop leaf panel comprises a front drop leaf panel pivotally mounted below the lowermost front sliding drawer, at least one drop leaf panel comprises a first side drop leaf panel pivotally mounted above the uppermost side sliding drawer and at least one drop leaf panel comprises a second side drop leaf panel pivotally mounted to the vertical support members opposite the first drop leaf panel.

2. The mobile cabinet and support as recited in claim 1, wherein said base and said upper panel are each substantially rectangular, said plurality of vertical support members comprising four vertical support members, each said vertical support member extending between corresponding corners of said upper panel and said base.

3. The mobile cabinet and support as recited in claim 2, further comprising at least one sidewall.

4. The mobile cabinet and support as recited in claim 3, wherein the at least one sidewall comprises first and second laterally opposed sidewalls.

5. The mobile cabinet and support as recited in claim 4, wherein the first sidewall at least partially covers the upper portion of the open interior region and is positioned above and adjacent to the uppermost side sliding drawer.

6. The mobile cabinet and support as recited in claim 5, further comprising a rear wall.

7. The mobile cabinet and support as recited in claim 6, further comprising a front wall, the front wall at least partially covering the lower portion of the open interior region and being positioned below and adjacent to the lowermost front sliding drawer.

8. The mobile cabinet and support as recited in claim 1, wherein the second side drop leaf panel is located at a higher elevation than the first side drop leaf panel.

9. The mobile cabinet and support as recited in claim 1, further comprising a drawer located above the first side drop leaf panel.

* * * * *